US005642834A

United States Patent [19]

Shaw et al.

[11] Patent Number: 5,642,834

[45] Date of Patent: Jul. 1, 1997

[54] SECONDARY CONTAINMENT RESERVOIR DEVICE

[76] Inventors: Mark D. Shaw, 9820 Preston Trail, Ponte Vedra Beach, Fla. 32082; J. Tad Heyman, 11858 Olde Oaks Court N., Jacksonville, Fla. 32223; Laurence M. Bierce, 105 Sandra Rd., Jacksonville, Fla. 32211; Jesse Ehredt, 1711 Duffton Ln., Painesville, Ohio 44077

[21] Appl. No.: 517,148

[22] Filed: Aug. 21, 1995

[51] Int. Cl.[6] ..... B65D 25/00

[52] U.S. Cl. ..... 220/720; 220/571; 220/573; 588/249; 588/259

[58] Field of Search ..... 405/52; 588/249, 588/259; 220/571, 573, 403, 404, 694, 720

[56] References Cited

U.S. PATENT DOCUMENTS

| | | | |
|---|---|---|---|
| 4,153,155 | 5/1979 | Benno | 220/573 X |
| 4,610,039 | 9/1986 | Stern | 220/404 X |
| 5,007,557 | 4/1991 | Spence | 220/571 |
| 5,099,872 | 3/1992 | Tarvin et al. | 220/573 X |
| 5,118,004 | 6/1992 | Carilli | 220/571 X |
| 5,199,457 | 4/1993 | Miller | 220/571 X |
| 5,254,798 | 10/1993 | Zoback | 588/249 X |

*Primary Examiner*—Tamara L. Graysay
*Assistant Examiner*—Frederick Lagman
*Attorney, Agent, or Firm*—Thomas C. Saitta

[57] ABSTRACT

A secondary containment reservoir device having a bottom and side walls forming a reservoir, and communicating with the reservoir an expandable retention bladder which automatically expands to receive liquid from the reservoir, allowing the total capacity of the device to greatly exceed the capacity of the reservoir alone. The device can be adapted to receive or support any type of primary liquid container above the reservoir, including drums, barrels, tanks, IBC's, tanker vehicles, tanker trailers or railroad tankers. In one embodiment, the reservoir is formed within a pallet having a support deck to receive drums or barrels of liquid. A single bladder or multiple bladders may be used, and the bladders may be mounted internally or externally.

18 Claims, 2 Drawing Sheets

FIG 4
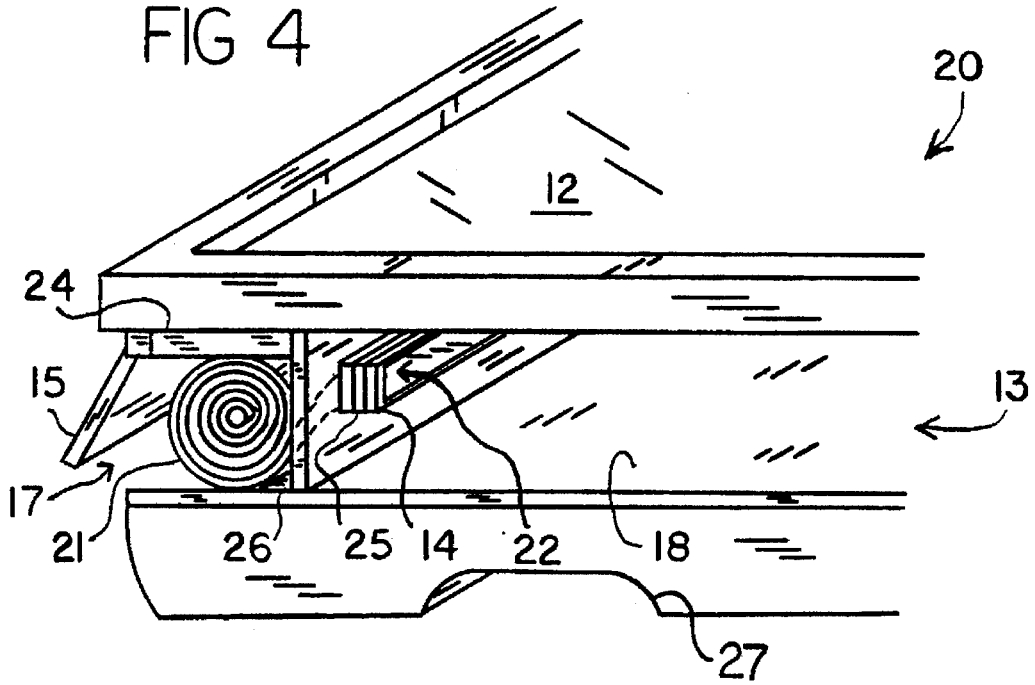
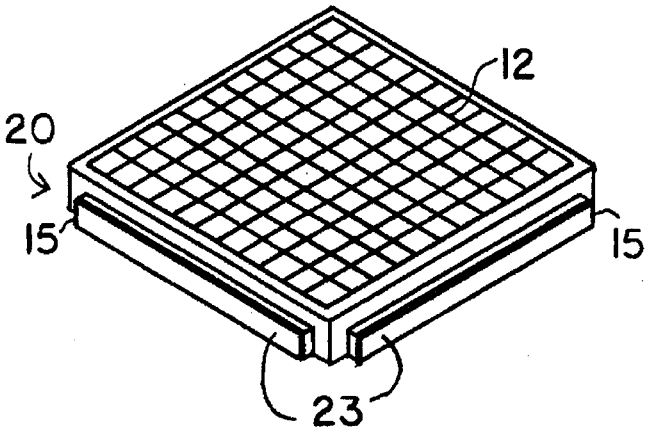
FIG 5
FIG 6
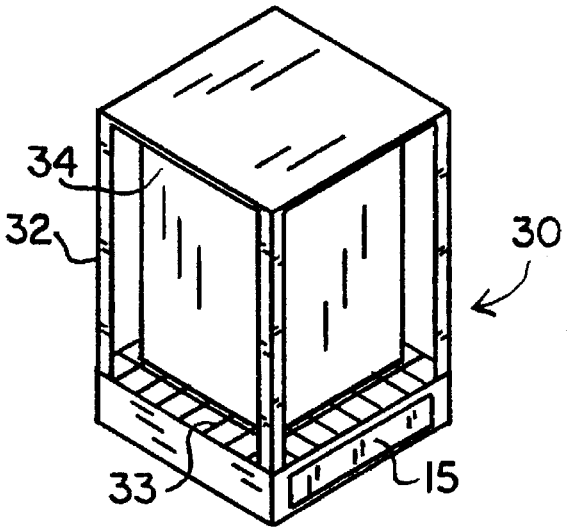

SECONDARY CONTAINMENT RESERVOIR DEVICE

BACKGROUND OF THE INVENTION

The invention relates generally to the field of devices used for secondary containment of hazardous liquid spills from primary containers such as barrels, drums, tanks, tanker vehicles, tanker trailers, railroad tanker cars, or drums or other primary containers stored on or supported by the pallets, the secondary containment devices having a reservoir or sump area to retain liquid and prevent its loss into the environment. More particularly, the invention relates to such secondary containment devices which have a reservoir with expandable capacity, and even more particularly, to such devices where the expandable reservoir reacts automatically to contain large volume liquid spills.

Hazardous liquid materials are stored in primary container means such as large drums or barrels of 30, 55 or 83 gallon capacity, large rectangular containers known as intermediate bulk containers (IBC) with capacities in the range of 120 to 600 gallons, large capacity storage tanks, tanker vehicles, tanker trailers or tanker railroad cars. Often one or more drums or containers will be placed onto a pallet for easy movement by a forklift or hand truck apparatus. Because there is a high likelihood of leakage or spillage of the liquid, secondary containment reservoir devices or pallets have been developed which retain any liquid spillage in a large volume sump area. For secondary containment pallets, regulations promulgated by the Environmental Protection Agency require the sump area to retain 100% of the volume of the single largest storage drum to be supported on the pallet, while the Uniform Fire Code requires a minimum sump area volume of 66 gallons. The containment devices generally consist of four vertical walls and a solid bottom, with some sort of support means to elevate the drums, tanks, vehicles, etc., above the sump area. This support means usually takes the form of raised ridges or column members extending upward from the bottom of the sump area, means to support a separate perforated deck or platform above the sump area, either with centrally located support columns or a peripheral support shoulder incorporated on the inside of the walls, or provisions to allow the vehicle or trailer wheels to pass into the sump area. An example of a secondary containment pallet of the type discussed above is shown in U.S. Pat. No. 4,930,632 to Eckert et al.

For circumstances where pallets are used, because the storage drums or intermediate bulk containers can be very heavy when filled and because the drums are often stored in multiples of two or four drums on a single pallet, it is difficult to design a containment pallet with sufficient strength which has the necessary sump capacity, especially when taking into consideration that the optimum design will have low side walls and a low deck height to make loading and unloading the drums safer and easier. To maximize the volume of the sump area it is also desirable to reduce the number of internal support members for the deck, meaning that a peripheral support for the deck is the preferred construction. In those containment pallets having a deck supported on a peripheral shoulder or lip located near the top of the side walls however, the compressive forces push against the side walls, causing them to bow or flex outward and eventually leading to failure of the pallet wall structure. This deflection problem was addressed in U.S. Pat. No. 5,359,955 to Grebenyuk by providing internal supports which extend from the midpoint of each side wall, creating a T-shape in horizontal cross-section. The supports extended from the bottom of the sump area to the top, the supports creating a surface onto which the deck is placed. The problem with this solution is that the supports themselves occupy a large area of the sump area, which means that the side wall height must be increased to compensate for this lost containment volume. In circumstances with large volume containers, such as tanks, tanker vehicles, tanker trailers and railroad tanker cars, the extremely large volume of liquid stored in the primary containers is so great that providing a secondary containment device with a large enough reservoir which is still accessible by the vehicles yet does not occupy a large volume of space has likewise caused difficulty.

It is an object of this invention to provide a large volume secondary containment reservoir device which has a relatively small profile or configuration, such that the device does not occupy a large space, and which includes an expandable reservoir or sump area automatically responsive to large volume liquid spills, the device being applicable for use with all types of primary containers, including but not limited to drums, barrels, IBC's, tanks, tanker vehicles, tanker trailers and railroad tanker cars. It is a further object of this invention to solve the problem of providing a large volume reservoir or sump area integral with a containment pallet without significantly increasing the overall dimensions of the pallet, thereby providing the necessary strength for support of the drums or intermediate bulk containers without recourse to extensive heightening of the side walls. It is an object to provide such a pallet which is responsive to a large volume spill with an expandable reservoir, such that the reservoir maintains a low volume configuration until needed to retain the liquid. It is a further object to provide such a pallet where the space occupied by the pallet is minimal until expansion of the reservoir. It is a further object to provide such a pallet where the expandable reservoir comprises a non-rigid bladder maintained in a coiled configuration, the bladder being self-opening in response to pressure from the liquid spill.

SUMMARY OF THE INVENTION

The invention comprises in general a secondary containment reservoir device having a bottom, four side walls, means to support or position one or more primary containers of liquid above the sump area formed by the bottom and side walls, and expandable retention means, such as a bladder, automatically expandable in response to a large volume liquid spill to increase the total effective containment volume of the reservoir. In one particular embodiment the bottom and four side walls are themselves adapted as a pallet to allow insertion of a fork lift or hand truck for movement of the pallet and jointly form a reservoir to retain liquid, with the device further comprising support means to support primary liquid containers, such as drums, barrels or intermediate bulk containers, whereby the support means allows liquid to pass into the reservoir area, and where the expandable reservoir or bladder means has an inlet port connected to the reservoir, whereby liquid in the reservoir can flow into the interior of the bladder. The bladder is connected to the reservoir device or pallet in such manner that it is stored in a low volume configuration, it being coiled, rolled or folded, such that it expands to a large volume configuration by uncoiling, unrolling or unfolding when liquid begins to enter the inlet port of the bladder, the pressure of the liquid providing the necessary force to reposition the bladder. The bladder is preferably constructed of a non-rigid, relatively unstructured, liquid-impermeable material such as a rubber, coated fabric or polymer. The bladder may be attached to the exterior of the device or may be incorporated internally with expansion through a slot or door member. The bladder may incorporate a drain or sealed outlet, and may comprise multiple layers of material to increase strength or tear-resistance. Plural bladders may be connected to a single reservoir device or pallet such that the same total expandable volume for liquid retention is obtained through the combination of smaller individual bladders.

BRIEF DESCRIPTION OF THE DRAWINGS

FIG. 4 is an exposed perspective view of an alternative pallet embodiment of the invention.

FIG. 5 is a perspective view of another alternative pallet embodiment illustrating plural bladders attacked to the exterior of the pallet side walls.

FIG. 6 is a perspective view of another alternative embodiment showing the invention incorporated into an intermediate bulk container.

DETAILED DESCRIPTION OF THE INVENTION

Figure 1:
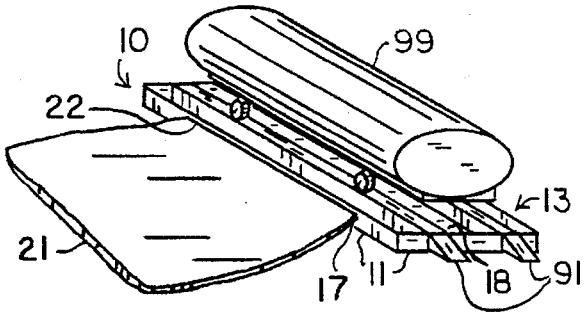
FIG. 1 is a perspective view of the general embodiment of the invention showing placement beneath a tanker trailer.

With reference now to the drawings, the invention will be described with regard to the best mode and preferred embodiment. The invention is a secondary containment reservoir 10 generally comprising a bottom 18 joined with four upstanding side walls 11 to form an open-topped reservoir or sump area 13. In the pallet embodiment 20, the device further comprises an apertured or slotted support grate or deck 12 positioned above the reservoir 13 and typically resting on the side walls 11 and/or support members extending from the bottom 18 for supporting drums, barrels, intermediate bulk containers or other liquid containers. The reservoir 13 retains liquid leaked or spilled from the primary containers, thus preventing contamination of the environment in the case of hazardous waste storage.

Communicating with the reservoir 13 is a retention member 21, which can be generally referred to as a bladder, such that liquid within the reservoir 13 can enter the interior of the bladder 21 through an inlet port 22. Bladder 21 is comprised of any generally non-rigid, non-structured, liquid-impermeable material which allows bladder 21 to be folded, coiled, rolled or otherwise disposed into a low volume configuration. For example, suitable materials for the construction of bladder 21 may be coated fabric, rubber or polymers. Preferably the material for bladder 21 is also chemical, tear and abrasion resistant. Bladder 21 may be composed of a single thin layer of material or may be composed of multiple layers, and may be further reinforced along seams or the like to further protect the integrity of the bladder 21 against leakage or rupture. A sealed drain 31 may be added to the bladder 21 to provide for easy removal of the liquid from the bladder 21. The bladder 21 may be constructed to have lateral flaps or pleats to provide for greater expansion.

Referring now to FIG. 1, a secondary containment reservoir 10 in the nature of the invention is shown positioned under a large tanker trailer 99 with a leak which shows the bladder 21 in the expanded or filled state. The bladder 21 communicates with the reservoir 13 formed by the combination of the four side walls 11 and the bottom 18, such that when the fluid level in the reservoir 13 reaches the level of inlet port 22, the liquid then expands and fills bladder 21. In this manner the total liquid containment volume of the secondary containment reservoir device 10 can be greatly increased beyond the limited capacity of the reservoir 13 alone. When not required to retain a liquid spill, the bladder 21 is preferably rolled or coiled into a small configuration so as not to interfere with other operations in the area. Raised support ramps or pathways 91 elevate the tanker trailer 99 above the reservoir 13. In other embodiments, the support pathways 91 can incorporate railroad tracks for movement of railcars across the reservoir device 10.

Figure 2:
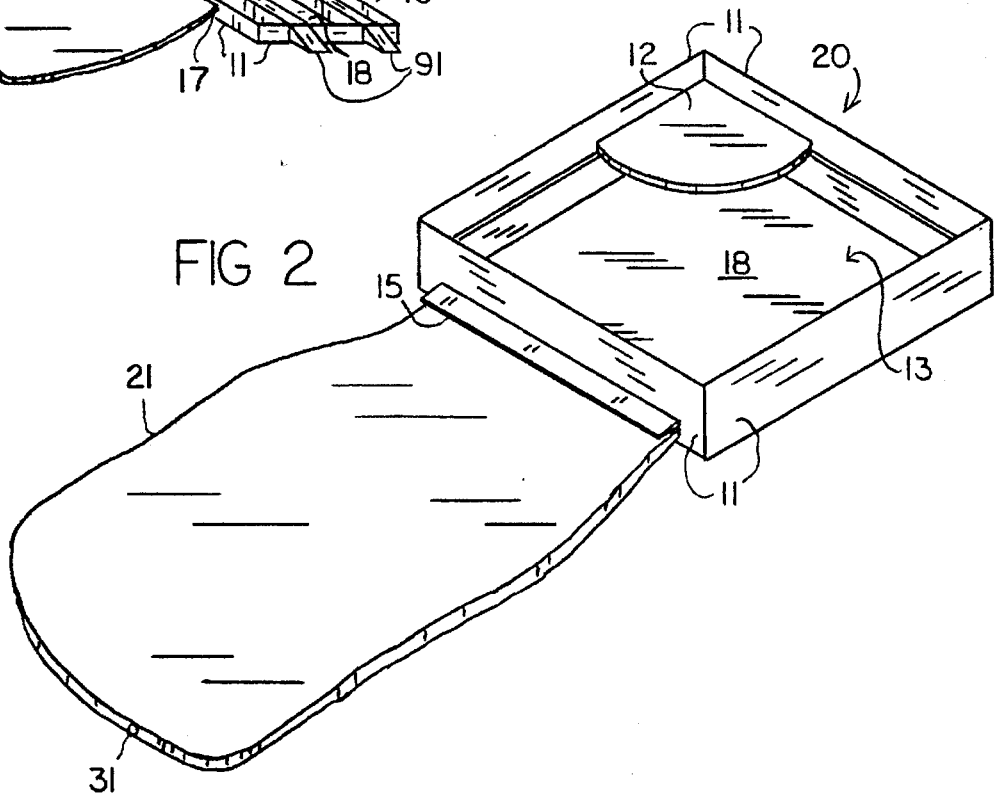
FIG. 2 is a perspective view illustrating the pallet embodiment with part of the support deck removed to expose the reservoir and showing the bladder in the expanded configuration.
Figure 3:
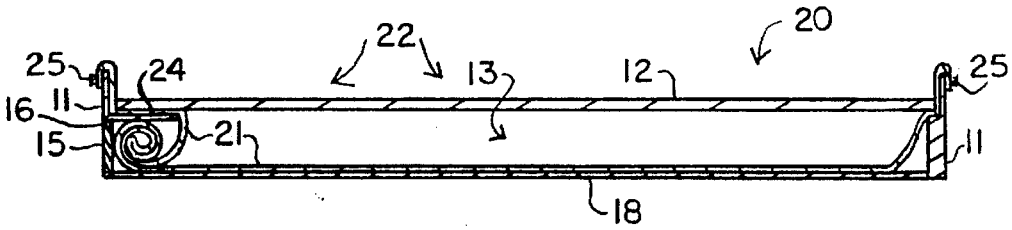
FIG. 3 is a cross-sectional side view of the pallet embodiment.

Referring now to FIG. 2 and subsequent FIGS. 3 through 5, the embodiment of the device as a secondary containment pallet 20 is shown, the pallet 20 likewise comprising in general four side walls 11 and a bottom 18 forming the reservoir 13. The expandable retention means or bladder 21 communicates with the reservoir 13. The support deck 12, shown partially removed, supports the liquid containers (not shown). Liquid flowing through or around the edge of the support deck 12 is retained in the reservoir 13. When the volume of that liquid reaches a critical amount, the pressure within the inlet port 22 of the bladder 21 causes it to expand out through a slot 17 or hinged door 15 in one of the side walls 11. The door 15 may be attached to the pallet 10 by simple pivoting means 16, as shown in the figure. The bladder 21 when unrolled creates a large volume storage area of sufficient size to retain most or all the liquid contained above the device 20, thereby significantly increasing the storage capacity of the pallet 20 when necessary. This allows the pallet 20 to be constructed with a relatively small reservoir 13 and low side walls 11, which obviates the need for specialized designs to increase wall strength as is required for pallets with taller walls and which allows easier loading and unloading of primary containers onto the pallet 20. The pallet 20 may be constructed such that the bottom 18 includes fork lift insertion members 27, apertures adapted to receive the tines of a fork lift or hand truck, such that the entire unit can be easily transported.

As seen in FIGS. 3 and 4, the bladder 21 occupies a very small volume when in the non-expanded state. Preferably, the bladder 21 is rolled or coiled such that the pressure from liquid in the reservoir 13 will push against the roll or coil, propelling the bulk of the bladder 21 out from the pallet side wall 11 where there is ample space to allow for its expansion. As shown in FIG. 3, one embodiment provides for the bladder 21 to be constructed to allow it to encompass the entire reservoir 13, with its edge being attached to the side walls 11 by fastening means 25, such as mechanical fasteners, metallic or elastic bands, or other suitable means. In this embodiment the inlet port 22 envelops the support deck 12, such that any liquid spill immediately enters the interior of the bladder 21. An alternative embodiment is shown in FIG. 4, in which the inlet port 22 of the bladder 21 is connected to a reservoir outlet 14 by suitable fastening means 25. Here the initial liquid spill fills the reservoir 13 of the pallet 20. Once a large volume begins to collect, the surface of the liquid in the reservoir 13 reaches the reservoir outlet 14 and begins to fill the bladder 21. As before, when there is sufficient liquid volume to create sufficient pressure, the bladder 21 uncoils and expands out of the side wall 11, in this instance through a slot 17 with no covering. The location and size of the reservoir outlet 14 can be varied to control how quickly the bladder 21 will be expanded.

As shown in FIGS. 3 and 4, it is preferred to restrict the vertical movement of the bladder 21 in the coiled state by provision of restriction means 24, which is shown as a generally horizontally disposed plate. As the liquid begins to fill the bladder 21, the bladder 21 initially tends to move in the vertical direction rather than outward. By placing restriction means 24 above the coiled bladder 21, the only direction of free expansion for the bladder 21 is out through the door 15 or slot 17. Restriction means 24 can be a separate component attached to the pallet 20 or it may be an integrally designed component of the pallet 20 itself, comprising for example part of the shoulder to support the support deck 12. Additionally, the preferred embodiment provides for a barrier means 26, shown in FIG. 4 as a ridge member having a sloped or curved surface directed toward the bladder 21, which further channels the pressure from the liquid into the bladder 21 such that the bladder 21 is easily uncoiled.

Still another alternative embodiment for the invention is shown in FIG. 5, in which multiple bladders 21 are contained in external bladder housings 23 with doors 15. The provision of multiple bladders 21, whether housed externally or internally relative to the reservoir 13 and pallet side walls 11, and whether provided with doors 15, slots 17 or simply mounted externally with no housings 23, allows for the use of individual bladders 21 with smaller overall volume when expanded—the total volume of all the bladders 21 equalling or even surpassing that of a large single bladder 21. This construction is useful where there are impediments to the complete expansion of a large bladder 21, such as in situations with relatively limited floor space. When multiple bladders 21 of large capacity are provided, such that the overall capacity of the reservoir 13 and multiple bladders 21 far exceed the projected maximum required volume, the bladders 21 act as a fail-safe mechanism which provides adequate containment volume in the event that one or more of the individual bladders is impeded from opening fully. While shown in FIG. 5 on the pallet 20 embodiment, it is contemplated that multiple bladders 21 can be provided on the basic general device 10 or any of the alternative embodiments.

Still another alternate embodiment is shown in FIG. 6, in which the expandable retention means 21 is incorporated directly into an intermediate bulk container (IBC) 30. An IBC 30 comprises a rigid outer framework 32 with a platform 33 to support a primary liquid container 34. The bladder 21 is integrated into the bottom of the IBC 30 in any of the manners described above which allows for expansion in the event of leakage or rupture of the non-rigid primary liquid container 34.

It is contemplated that equivalents and substitutions to the above may be obvious to those skilled in the art, and the true scope and definition of the invention therefore is to be as set forth in the following claims.

We claim:

1. A secondary containment reservoir device having an expandable liquid retention capacity comprising a bottom and side walls joined to form a reservoir to retain liquids and an expandable liquid retention means mounted externally to said side walls and communicating with said reservoir through an inlet port, said retention means comprising a bladder composed of a non-rigid, liquid-impermeable material stored within a housing in a low volume configuration which automatically expands to receive liquid from said reservoir.

2. The device of claim 1, further comprising means to support one or more primary liquid container means above said reservoir.

3. The device of claim 2, where said support means comprise raised pathways for wheeled vehicles.

4. The device of claim 2, where said support means comprise a support deck.

5. The device of claim 2, where said support means is a framework for supporting a primary liquid container having non-rigid sides.

6. The device of claim 1, where said housing further comprises a door member.

7. The device of claim 1, further comprising additional liquid retention means.

8. A secondary containment reservoir device comprising a bottom and four side walls joined to form a liquid retention reservoir, a support deck for supporting one or more primary liquid containers, and an expandable liquid retention means comprising a bladder composed of a non-rigid, liquid-impermeable material mounted externally to said side walls within a housing in a low volume configuration and communicating with said reservoir, where said retention means expands automatically to receive liquid from said reservoir.

9. The device of claim 8, where said retention means communicates with said reservoir through an inlet port.

10. The device of claim 8, said housing further comprising a door member.

11. The device of claim 8, where said retention means is a bladder composed of a non-rigid, liquid-impermeable material.

12. The device of claim 11, where said retention means is stored in a low volume configuration.

13. The device of claim 11, where said bladder further comprises a drain member.

14. The device of claim 8, further comprising additional liquid retention means.

15. The device of claim 8, further comprising restrictor means to prevent vertical movement of said retention means.

16. The device of claim 8, further comprising barrier means to control movement of said retention means.

17. A secondary containment reservoir device comprising a bottom and four side walls joined to form a liquid retention reservoir, said bottom having fork lift insertion members, a support deck for supporting one or more primary liquid containers, and an expandable liquid retention means comprising a bladder composed of a non-rigid, liquid-impermeable material mounted externally to one of said side walls within a housing in a low volume configuration and communicating with said reservoir, where said retention means expands automatically to receive liquid from said reservoir.

18. The device of claim 17, further comprising additional liquid retention means.

* * * * *